US012735949B2

(12) United States Patent
Holen et al.

(10) Patent No.: US 12,735,949 B2
(45) Date of Patent: Sep. 15, 2026

(54) BOOST SYSTEM FOR A HOISTING SYSTEM

(71) Applicant: Schlumberger Technology Corporation, Sugar Land, TX (US)

(72) Inventors: Dag Holen, Kristiansand (NO); Arve Pedersen, Kristiansand (NO); Haavard Saetervik, Kristiansand (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/141,070

(22) PCT Filed: Feb. 9, 2024

(86) PCT No.: PCT/US2024/015221

§ 371 (c)(1),
(2) Date: Jun. 19, 2025

(87) PCT Pub. No.: WO2024/173180

PCT Pub. Date: Aug. 22, 2024

(65) Prior Publication Data

US 2026/0210195 A1 Jul. 23, 2026

Related U.S. Application Data

(60) Provisional application No. 63/484,585, filed on Feb. 13, 2023.

(51) Int. Cl.
*E21B 19/06* (2006.01)

(52) U.S. Cl.
CPC ..... *E21B 19/06* (2013.01)

(58) Field of Classification Search
CPC ..... E21B 19/06
See application file for complete search history.

(56) References Cited

U.S. PATENT DOCUMENTS

| | | | | |
|---|---|---|---|---|
| 6,095,501 | A * | 8/2000 | Vatne | E21B 19/086 254/386 |
| 9,080,383 | B2 * | 7/2015 | Meillet | F16D 63/006 |
| 10,633,936 | B2 * | 4/2020 | Aslaksen | E21B 19/006 |
| 2014/0027106 | A1 * | 1/2014 | Huseman | E21B 19/20 166/85.1 |
| 2017/0051847 | A1 * | 2/2017 | Roodenburg | E21B 19/24 |
| 2017/0121162 | A1 * | 5/2017 | Bergan | B66C 23/52 |
| 2018/0179833 | A1 * | 6/2018 | Richardson | E21B 19/06 |
| 2019/0024465 | A1 * | 1/2019 | Gupta | E21B 19/14 |
| 2019/0264514 | A1 * | 8/2019 | Roodenburg | E21B 15/00 |
| 2019/0329098 | A1 * | 10/2019 | Anderson | F16G 11/106 |
| 2020/0181988 | A1 * | 6/2020 | Magnuson | E21B 19/06 |

FOREIGN PATENT DOCUMENTS

| | | | |
|---|---|---|---|
| CN | 209908502 U | * | 1/2020 |
| KR | 20100001123 U | | 2/2010 |

* cited by examiner

*Primary Examiner* — Steven A Macdonald
(74) *Attorney, Agent, or Firm* — Jeffrey D. Frantz

(57) ABSTRACT

A boost system for a hoisting system includes a track configured to couple to a mast. The boost system also includes a boost assembly with an upper climb unit with a respective hook configured to selectively engage openings in the track, a lower climb unit with a respective hook configured to selectively engage the openings in the track, and a boost actuator configured to drive the upper climb unit along the track and relative to the lower climb unit to provide a supplemental force to a yoke of the hoisting system.

7 Claims, 7 Drawing Sheets

BOOST SYSTEM FOR A HOISTING SYSTEM

CROSS-REFERENCE TO RELATED APPLICATION

This application is a National Stage Entry of International Application No. PCT/US2024/015221, filed Feb. 9, 2024, which claims priority to and the benefit of U.S. Provisional Patent Application No. 63/484,585, filed Feb. 13, 2023, which is incorporated by reference herein in its entirety.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admission of prior art.

Natural resources, such as oil and gas, are used as fuel to power vehicles, heat homes, and generate electricity, in addition to various other uses. Once a desired resource is discovered below a surface of the earth, drilling systems are often employed to access the desired resource (e.g., drilling operations) and production systems are often employed to extract the desired resource (e.g., production operations). These drilling systems and/or production systems may be located onshore or offshore depending on a location of the desired resource. Further, such drilling systems and/or production systems may include a wide variety of components, such as a hoisting system, fluid conduits, valves, pumps, and the like. In drilling systems, the hoisting system facilitates movement of a load and may be utilized to raise and to lower components (e.g., tubulars) relative to a well. The hoisting system may be supported on a mast that extends vertically above the well.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In some embodiments, a boost system for a hoisting system includes a track configured to couple to a mast. The boost system also includes a boost assembly with an upper climb unit with a respective hook configured to selectively engage openings in the track, a lower climb unit with a respective hook configured to selectively engage the openings in the track, and a boost actuator configured to drive the upper climb unit along the track and relative to the lower climb unit to provide a supplemental force to a yoke of the hoisting system.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
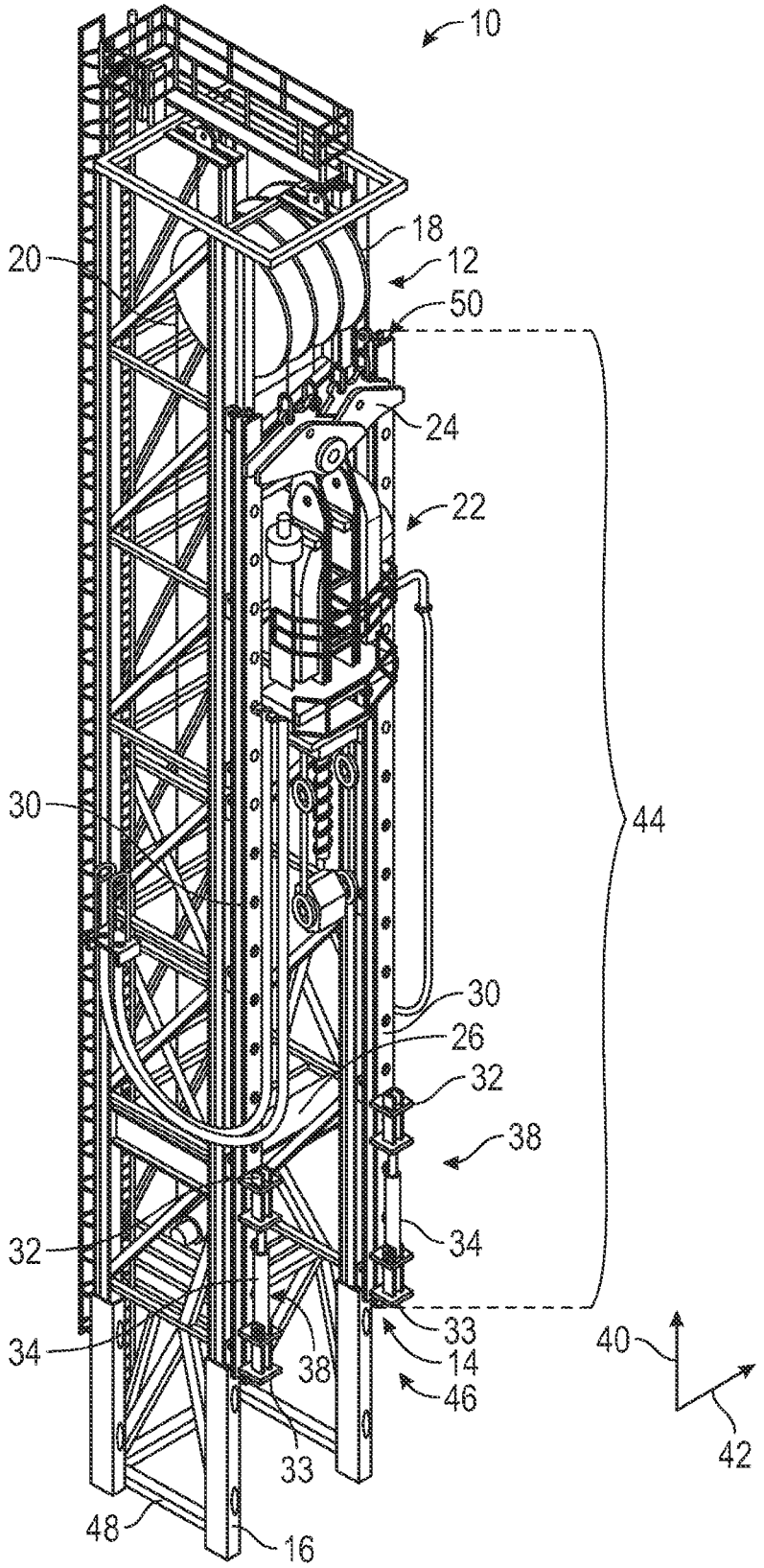
FIG. 1 is a perspective view of a boost system for a hoisting system, wherein the boost system extends along a mast, in accordance with an embodiment of the present disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements." The term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "top" and "bottom," and other like terms indicating relative positions to a given point or element are utilized to more clearly describe some elements. Commonly, these terms relate to a reference point at a surface from which drilling operations are initiated as being a top point and a total depth being a lowest point, wherein a well (e.g., wellbore, borehole) is vertical, horizontal, or slanted relative to the surface.

A drilling system may carry out drilling operations at a wellsite to form a well within or into a subterranean formation to recover hydrocarbons trapped within the subterranean formation. The present disclosure generally relates to a boost system for a hoisting system, as well as a method for operating the boost system in conjunction with the hoisting system to carry out various operations at the wellsite. For example, the boost system may be used to provide a supplemental force to supplement a hoisting force generated by the hoisting system to move a load at the wellsite, such as to trip in and trip out tubulars (e.g., drill pipes, casing).

The hoisting system may include or may be supported on a mast. The hoisting system may include a sheave, a cable, a hoisting assembly with a yoke (e.g., collar), and a hoisting actuator configured to provide the hoisting force to drive movement of the hoisting assembly and the load (e.g., tubulars) coupled thereto. The hoisting actuator may be one or more hydraulic cylinders supported by, on, and/or positioned within the mast. The boost system may include tracks that mount to the mast, climb units that move along the tracks, and boost actuators that drive the climb units to move along the tracks. In operation, the boost actuators drive the climb units along the tracks to engage the yoke of the hoisting system, which enables the boost system to provide the supplemental force to supplement the hoisting force from the hoisting actuator. In this manner, the boost system and the hoisting system may provide sufficient power to move heavy loads (e.g., too heavy to be moved by the hoisting system alone without the boost system).

Advantageously, the boost system may be applied or coupled to the mast based on needs and/or changes in desired maximum lifting capacity. Thus, operators may initially select the mast and the hoisting system with parameters that are sufficient to move expected loads, which may enable the operators to initially select the mast and the hoisting system with a smaller footprint, a lower weight, a lower cost, and/or a faster installation at the wellsite (e.g., as compared to the mast and the hoisting system that would be able to move loads that are greater than the expected loads). However, operators may be able to add the boost system (e.g., after installation of the mast and the hoisting system at the wellsite) at a later time based on needs and/or changes in desired maximum lifting capacity. In this way, the boost system and the hoisting system may be a modular system or design that provides flexibility with respect to the maximum lifting capacity.

With the foregoing in mind, FIG. 1 is a perspective view of an embodiment of a portion of a drilling system 10 with a hoisting system 12 and a boost system 14. As shown, the hoisting system 12 may include or may be supported on a mast 16 (e.g., frame). The hoisting system 12 may include a sheave 18, a wire 20 (e.g., hoisting wire), a hoisting assembly 22 with a yoke 24 (e.g., collar), and one or more hoisting cylinders 26 (e.g., one or more hoisting actuators) configured to provide a hoisting force to drive movement of the hoisting assembly 22 and a load (e.g., tubulars) coupled thereto. The one or more hoisting cylinders 26 may be one or more hydraulic cylinders supported by, on, and/or positioned within the mast 16.

The boost system 14 may include tracks 30 that mount (e.g., via fasteners, such as bolts) to the mast 16, upper climb units 32 and lower climb units 33 that move along the tracks 30, and boost actuators 34 (e.g., boost cylinders) positioned between the upper climb units 32 and the lower climb units 33 along a vertical axis 40. In operation, the boost actuators 34 drive the upper climb units 32 along the tracks 30 to engage the yoke 24 of the hoisting system 12, which enables the boost system 14 to provide a supplemental force to supplement the hoisting force provided by the one or more hoisting cylinders 26. Together, the supplemental force and the hoisting force may move heavier loads (e.g., as compared to the hoisting force alone without the supplemental force).

As described in more detail herein, the boost system 14 incrementally drives the upper climb units 32 and the lower climb units 33 along the tracks 30 (e.g., in a step-wise or step-by-step manner). The boost system 14 accomplishes this by controlling the boost actuators 34 to alternately drive the upper climb units 32 and the lower climb units 33 along the tracks 30 (e.g., via alternately extending and retracting the boost actuator) in coordination with alternately securing the upper climb units 32 and the lower climb units 33 to the tracks 30. For example, the boost actuators 34 drive the upper climb units 32 along the tracks 30 toward the yoke 24 and away from the lower climb units 33 via extension of the boost actuators 34 while the lower climb units 33 are secured to the tracks 30. Then, the boost actuators 34 drive the lower climb units 33 along the tracks 30 toward the yoke 24 and toward the upper climb units 32 via retraction of the boost actuators 34 while the upper climb units 32 are secured to the tracks 30.

The boost system 14 incrementally drives the upper climb units 32 and the lower climb units 33 along the tracks 30 in this way to incrementally move both boost assemblies 38 (each having a respective upper climb unit 32, a respective lower climb unit 33, and a respective boost actuator 34) toward the yoke 24 until the upper climb units 32 contact and engage the yoke 24. Then, the boost system 14 may continue to incrementally drive the upper climb units 32 and the lower climb units 33 along the tracks 30 in this way while the upper climb units 32 contact and engage the yoke 24 to thereby provide the supplemental force during each vertically upward movement of the upper climb units 32 (e.g., to supplement the hoisting force provided by the one or more hoisting cylinders 26). In this way, a total force applied to the yoke 24 and components supported below the yoke 24 (e.g., tubulars) may include the supplemental force provided by the boost actuators 34 in addition to the hoisting force provided by the one or more hoisting cylinders 26.

The boost system 14 may be operated to incrementally raise the upper climb units 32 and the lower climb units 33 upwardly along the vertical axis 40 to provide the supplemental force to the yoke 24, but also to incrementally lower the upper climb units 32 and the lower climb units 33 downwardly along the vertical axis 40 toward the well to thereby reposition the boost assemblies 38 for subsequent boost operations, for example. Additionally or alternatively, the upper climb units 32 may be configured to couple to the yoke 24 (e.g., via locks) and to decouple or disconnect from the tracks 30. Thus, the boost assemblies 38 may be suspended from the yoke 24. In such cases, the boost assemblies 38 may be efficiently lifted or lowered relative to the tracks 30 via movement of the yoke 24 due to the hoisting force provided by the one or more hoisting cylinders 26 (e.g., over larger distances, such as from a top portion of the tracks 30 to a bottom portion of the tracks 30; without a sequence of incremental steps along the track 30).

Figure 2:
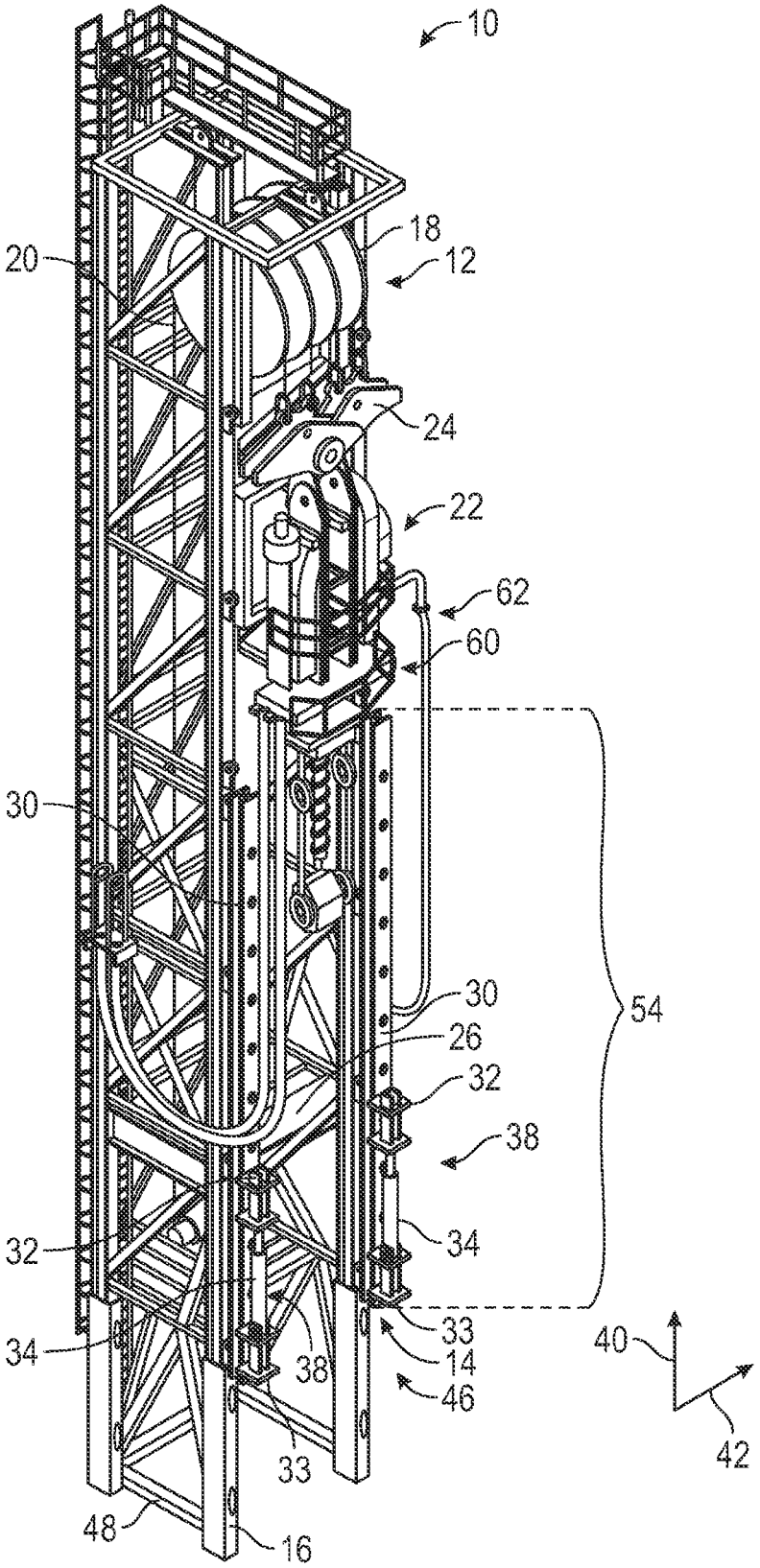
FIG. 2 is a perspective view of a boost system for a hoisting system, wherein the boost system extends along a lower portion of a mast, in accordance with an embodiment of the present disclosure.

To facilitate discussion, the portion of the drilling system 10 and components therein (e.g., the hoisting system 12, the boost system 14) may be described with reference to the vertical axis or direction 40 and a lateral axis or direction 42. In FIG. 1, the boost system 14 extends vertically along a first length or range 44 of the mast 16. For example, the tracks 30 extend from a first location 46 proximate to a base 48 of the mast 16 to a second location 50 proximate to the sheave 18. However, as shown in FIG. 2, the boost system 14 may instead extend vertically along a second length or range 54 of the mast 16. For example, the tracks 30 extend from the first location 46 proximate to the base 48 of the mast 16 to a third location 60 generally in a middle portion 62 of the mast 16 located between the sheave 18 and the base 58 of the mast 16 along the vertical axis 40. Indeed, the boost system 14 may be configured to extend vertically over any suitable length or range of the mast 16 (e.g., depending on desired lifting parameters and/or ranges).

Figure 3:
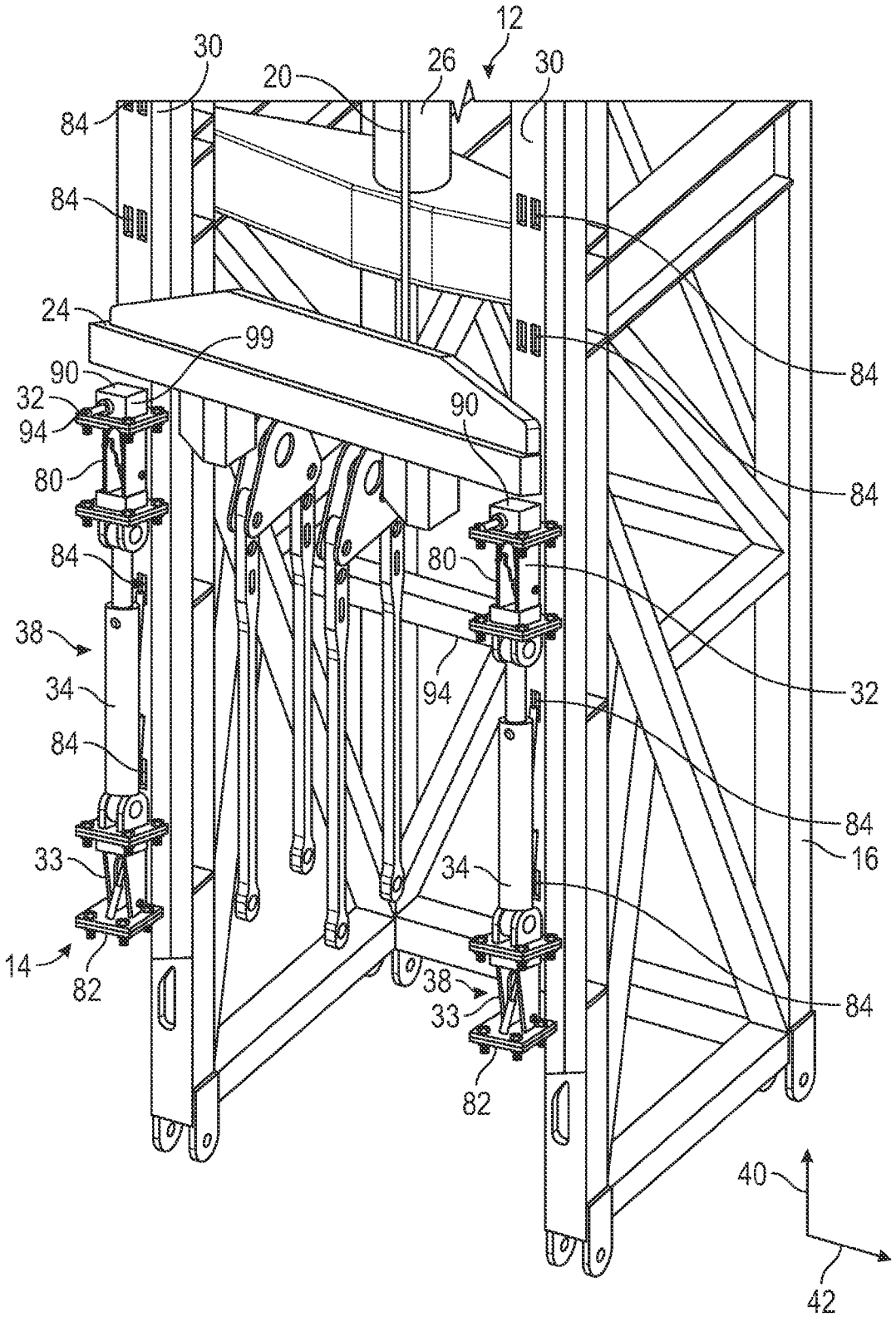
FIG. 3 is a perspective view of a boost system for a hoisting system, wherein the boost system is coupled to a mast and is positioned proximate to a yoke of the hoisting system, in accordance with an embodiment of the present disclosure.
Figure 4:
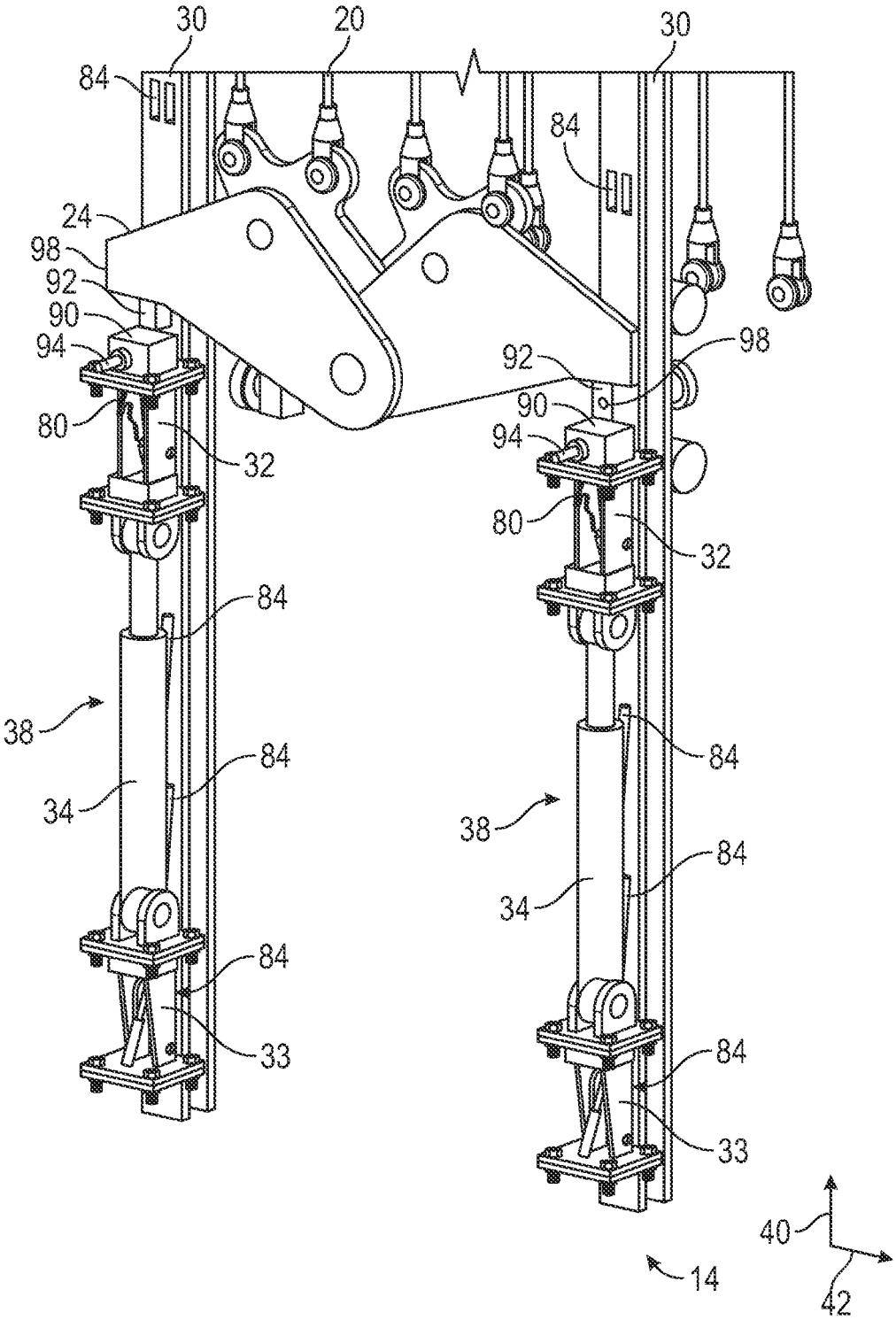
FIG. 4 is a perspective view of a boost system for a hoisting system, wherein the boost system is positioned proximate to a yoke of the hoisting system, in accordance with an embodiment of the present disclosure.

FIG. 3 is a perspective view of an embodiment of the boost system 14 that may be utilized together with the hoisting system 12, and FIG. 4 is a perspective view of an embodiment of the boost system 14 that may be utilized together with the hoisting system 12 of FIGS. 1-3. In FIG. 3, a portion of the hoisting system 12 and a portion of the mast 16 are shown; however, in FIG. 4, certain features of the hoisting system 12 and the mast 16 are removed for image clarity. Additionally, FIGS. 3 and 4 include certain structural differences to illustrate that various structures having various geometries (e.g., size, shape) and/or features may be employed to carry out disclosed techniques. For example, as shown in FIGS. 3 and 4, the yoke 24 may have various geometries and/or features.

With reference to FIG. 3, the hoisting system 12 includes the one or more hoisting cylinders 26, which may extend and retract to adjust a position of the yoke 24 relative to the mast 16. With reference to FIGS. 3 and 4, the hoisting system 12 also includes the wire 20 and the yoke 24.

With reference to FIGS. 3 and 4, the boost system 14 includes the upper climb units 32 and the lower climb units 33. The boost system 14 also includes the boost actuators 34. As noted herein, the boost system 14 may two boost assemblies 38 that each include one of the upper climb units 32, one of the lower climb units 33, and one of the boost actuators 34. Each of the two boost assemblies 38 is configured to move along a respective one of the tracks 30. Further, the two boost assemblies 38 may be operated together and in a coordinated manner (e.g., same movements simultaneously) to provide the supplemental force.

Again, with reference to FIGS. 3 and 4, in operation, operators and/or a controller (e.g., electronic controller) may determine that the hoisting force provided by the hoisting system 12 is insufficient for a particular lifting operation (e.g., to lift equipment from a well) and/or that the supplemental force is desired for the particular lifting operation. In response, the operators and/or the controller may active and control the boost system 14 to provide the supplemental force, as described herein.

As shown in FIGS. 3 and 4, the upper climb units 32 include hooks 80 and the lower climb units 33 include hooks 82. The tracks 30 include multiple openings 84 that are spaced apart at distinct, different locations along the vertical axis 40 (e.g., levels along the vertical axis 40). The hooks 80, 82 may be configured to selectively engage the multiple openings 84 to facilitate incremental movement of the upper climb units 32 and the lower climb units 33 along the tracks 30 with the boost actuators 34.

In particular, the boost system 14 may at an initial position with the hooks 80 of the upper climb units 32 engaged or inserted into a respective aligned set of the multiple openings 84 (e.g., at a first level) and with the hooks 82 of the lower climb units 33 engaged or inserted into a respective aligned set of the multiple openings 84 (e.g., a second level below the first level). Then, the hooks 80 of the upper climb units 32 may disengage from the respective aligned set of the multiple openings 84. Then, while the hooks 80 of the upper climb units are disengaged from the respective aligned set of the multiple openings 84 and while the hooks 82 of the lower climb units 33 are engaged or inserted into the respective aligned set of the multiple openings 84, the boost actuators 34 may extend to move (e.g., push) the upper climb units 32 along the tracks 30 toward the yoke 24 and away from the lower climb units 33.

If the upper climb units 32 do not contact the yoke 24 (e.g., the yoke 24 is too far above the upper climb units 32 for the upper climb units 32 to reach the yoke 24 via one extension of the boost actuators 34/one incremental movement of the upper climb units 32), then the hooks 80 of the upper climb units 32 may engage or insert into a respective aligned set of the multiple openings 84 (e.g., at a third level above the first level). Then, the hooks 82 of the lower climb units 33 may disengage from the respective aligned set of the multiple openings 84. Then, while the hooks 80 of the upper climb units 32 are engaged or inserted into the respective aligned set of the multiple openings 84 and while the hooks 82 of the lower climb units 33 are disengaged from the respective aligned set of the multiple openings 84, the boost actuators 34 may retract to move (e.g., pull) the lower climb units 33 along the tracks 30 toward the yoke 24 and toward the upper climb units 32. Then the hooks 82 of the lower climb units 33 may engage or insert into a respective aligned set of the multiple openings 84 (e.g., at a fourth level above the second level and below the third level). The boost system 14 may continue to incrementally move the upper climb units 32 and the lower climb units 33 in this manner until the upper climb units 32 contact the yoke 24.

For example, as shown in FIGS. 3 and 4, the upper climb units 32 are being driven toward the yoke 24 via the boost actuators 34 and will make contact with the yoke 24 during a current extension of the boost actuators 34. Once the upper climb units 32 make contact with the yoke 24, further extension of the boost actuators 34 (e.g., during the current extension or step) and/or subsequent extensions of the boost actuators 34 (e.g., during subsequent extensions or steps) provide the supplemental force that supplements the hoisting force from the one or more hoisting cylinders 26.

With reference to FIGS. 3 and 4, the upper climb units 32 may include recesses 90 that are configured to engage or receive protrusions 92 of the yoke 24. For example, the recesses 90 may be formed in vertically-facing, upper ends of the upper climb units 32, and the protrusions 92 may extend vertically downward from lower ends of the yoke 24.

In some embodiments, locks 94 (e.g., pins) may be configured to extend through lock openings 98 (FIG. 4) formed in the protrusions 92 of the yoke 24 to couple the upper climb units 32 (and thus, the boost assemblies 38) to the yoke 24 (and thus, to the hoisting system 12).

In particular, the locks 94 may be in an unlocked configuration (e.g., retracted) as the upper climb units 32 move toward the yoke 24, and then the locks 94 may move to a locked position (e.g., extended) once the protrusions 92 of the yoke 24 are received within the recesses 90 of the upper climb units 32. It should be appreciated that the locks 94 may couple the upper climb units 32 to the yoke 24 during the incremental lifting operations (e.g., during the incremental application of the supplemental force via the boost system 14) and/or to facilitate movement of the boost assemblies 38 along the tracks 30 via the hoisting system 12. For example, while the locks 94 are engaged with the yoke 24 and while the hooks 80, 82 are disengaged from the tracks 30, the boost assemblies 38 may be efficiently moved (e.g., raised and/or lowered) relative to the tracks 30 via the hoisting system 12. The ability to move the boost assemblies 38 relative to the tracks 30 via the hoisting system 12 may be particularly useful to lower the boost assemblies 38, such as to position the boost assemblies 38 for subsequent boost operations.

Figure 6:
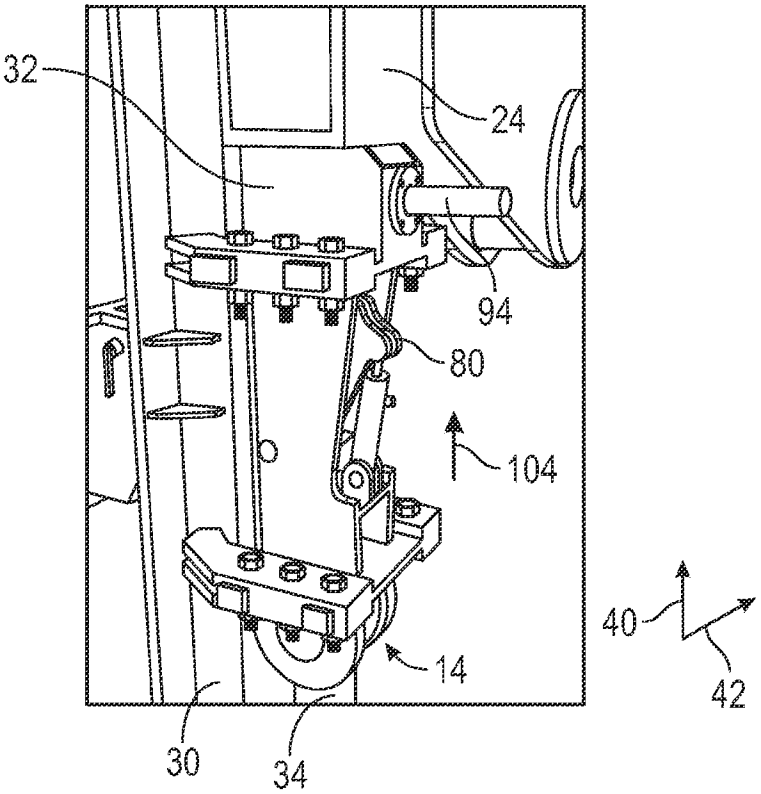
FIG. 6 is a perspective view of a portion of an upper climb unit that may be utilized in a boost system for a hoisting system, wherein the upper climb unit is in contact with a yoke of the hoisting system, in accordance with an embodiment of the present disclosure.
Figure 5:
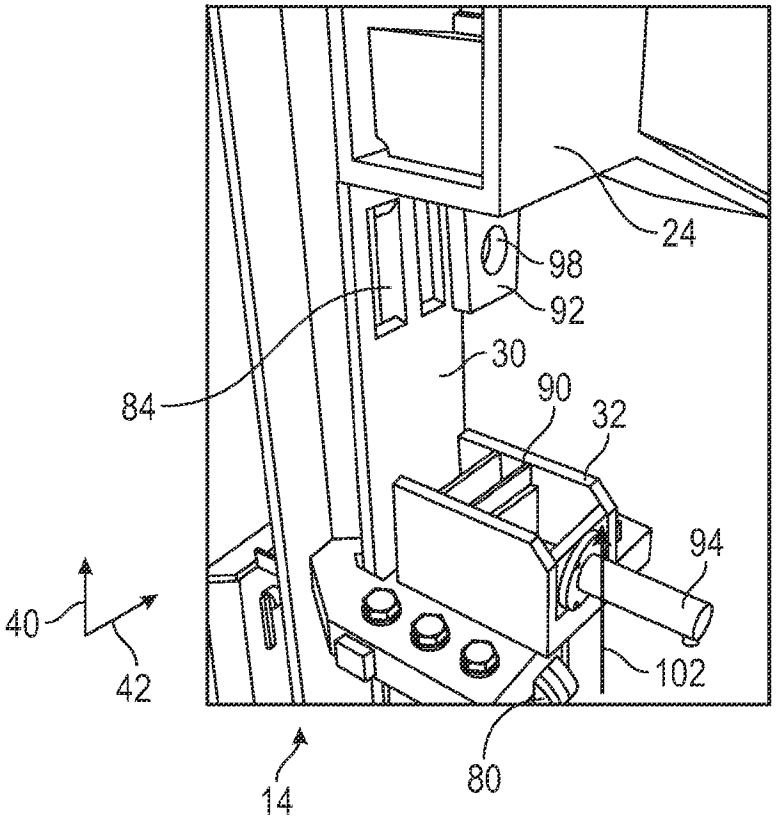
FIG. 5 is a perspective view of a portion of an upper climb unit that may be utilized in a boost system for a hoisting system, in accordance with an embodiment of the present disclosure.

FIGS. 5-8 illustrate additional details of certain features of the boost system 14. In particular, FIG. 5 is a perspective view that illustrates a portion of one of the upper climb units 32 being driven vertically toward the yoke 24, as shown by arrow 102. FIG. 6 is a perspective view that illustrates a portion of one of the upper climb units 32 engaged with the yoke 24. As described herein, the upper climb units 32 may be driven vertically toward the yoke 24 via extension of the boost actuators 34 of FIGS. 1-4.

With reference to FIG. 5, the upper climb units 32 may be driven vertically toward the yoke 24 until the protrusions 92 of the yoke 24 insert into the recesses 90 of the upper climb units 32. The locks 94 may be actuated (e.g., via a lock actuator) to extend through the lock openings 98 formed in the protrusions 92. In FIG. 5, one set of the multiple openings 84 is positioned adjacent to the yoke 24. In such cases, the hooks 80 of the upper climb units 32 may engage or insert into the aligned set of the multiple openings 84. Then, as described herein, the lower climb units 33 shown in FIGS. 1-4 may disengage from the tracks 30, the boost actuators 34 may retract to pull the lower climb units 33 toward the upper climb units 32, and the lower climb units 33 may engage with the tracks 30. Then, the boost actuators 34 may extend to push the upper climb units 33 and the yoke 24 coupled thereto vertically upwardly from their position shown in FIG. 6 and as shown by arrow 104. In this way, the boost actuators 34 may provide the supplemental force.

Figure 8:
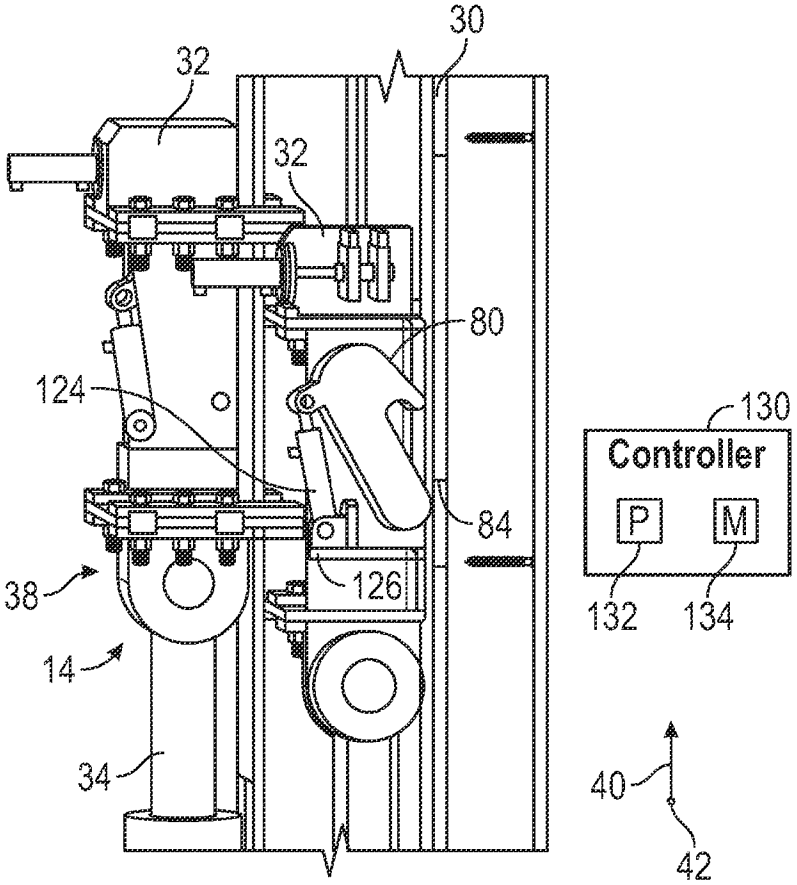
FIG. 8 is a cross-sectional side view of a portion of an upper climb unit that may be utilized in a boost system for a hoisting system, wherein the upper climb unit includes a hook in a disengaged configuration, in accordance with an embodiment of the present disclosure.
Figure 7:
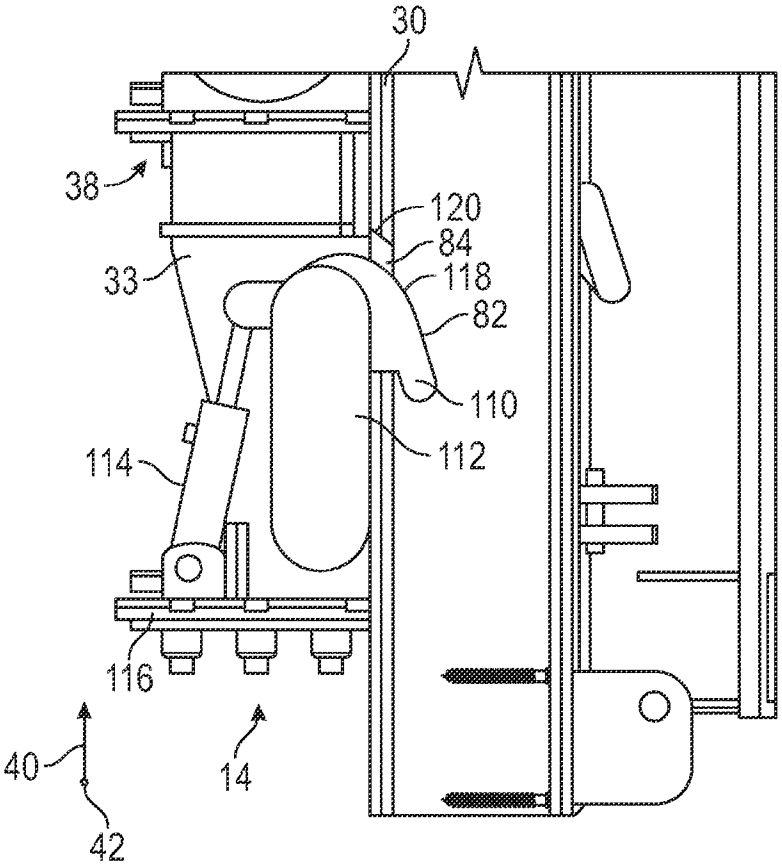
FIG. 7 is a cross-sectional side view of a portion of a lower climb unit that may be utilized in a boost system for a hoisting system, wherein the lower climb unit includes a hook in an engaged configuration, in accordance with an embodiment of the present disclosure.

FIGS. 7 and 8 illustrate cross-sectional side views of an embodiment of a portion of the boost system 14. In particular, FIG. 7 illustrates one of the hooks 82 of one of the lower climb units 33 in an engaged configuration, while FIG. 8 illustrates one of the hooks 80 of one of the upper climb units 33 in a disengaged configuration. It should be appreciated that each of the hooks 80, 82 may adjust between the engaged configuration in which the hooks 80, 82 engage or insert into an aligned set of the multiple openings 84 and the disengaged configuration in which the hooks 80, 82 are withdrawn from the multiple openings 84. Further, in the engaged configuration, the hooks 80, 82 block movement of the upper and lower climb units 32, 33, respectively, relative to the respective track 30. However, in the disengaged configuration the hooks 80, 82 permit or enable (e.g., do not block) movement of the upper and lower climb units 32, 33 relative to the respective track 30.

The hooks 80, 82 may be shaped, passively biased (e.g., via biasing members, such as hydraulic cylinders), and/or actively actuated (e.g., via hydraulic cylinders) to engage with and/or to disengage from the multiple openings 100. For example, with reference to FIG. 7, the hook 82 includes a hook portion 110 that hooks onto a lower edge 112 of the opening 84. Thus, in the engaged configuration, the hook portion 110 blocks movement of the lower climb unit 33 vertically downward. As shown in FIG. 7, a hook cylinder 114 may extend between a support structure 116 of the lower climb unit 33 and the hook 82. The hook cylinder 114 may be or may be capable of operating as a biasing member that biases the hook 82 toward the engaged configuration. For example, during lifting operations, the biasing force applied by the hook cylinder 114 to the hook 82 may cause the hook 82 to extend or insert into each opening 84 in response to vertical alignment with the opening 84. However, the biasing force applied by the hook cylinder 114 to the hook 82 may be overcome and enable withdrawal of the hook 82 from the opening 84 upon vertically upward movement of the lower climb unit 33. For example, a curved or tapered upper portion 118 of the hook 82 and/or a corresponding tapered upper edge 120 of the opening 84 enable the hook 82 to move out of the opening 84 upon the vertically upward movement of the lower climb unit 33.

In some embodiments, the hook cylinder 114 may be or may be capable of operating as an active hydraulic cylinder that actively drives movement of the hook 82 relative to the lower climb unit 33 to adjust between the engaged configuration and the disengaged configuration. For example, the hook cylinder 114 may actively withdraw the hook 82 away from the track 30 to facilitate and/or to enable movement of the lower climb unit 33 relative to the track 30, which may be particularly useful to facilitate lowering of the boost assemblies 38 (e.g., via incremental movements via the boost system 14; via the hoisting system). For example, FIG. 8 illustrates the hook 80 in the disengaged configuration, which may be achieved via driving the upper climb unit 32 vertically upward relative to the track 30 to withdraw the hook 80 from one of the multiple openings 84, and then sliding along a section of the track 30 between adjacent sets of the multiple openings 84. In such cases, a hook cylinder 124 that is coupled between the hook 80 and a support structure 126 of the upper climb unit 32 may be compressed (e.g., to overcome the biasing force when operating in a passive manner). However, as noted herein, the hook 80 may be driven into the disengaged configuration via retraction (e.g., active control) of the hook cylinder 124. To facilitate adjustment between the engaged configuration and the disengagement configuration, the hook cylinders 114, 124 may be pivotally (e.g., rotatably) coupled to the support structures 116, 126 and/or to the hooks 80, 82, as shown.

While FIG. 7 illustrates the hook 82 in the engaged configuration and FIG. 8 illustrates the hook 80 in the disengaged configuration to facilitate discussion, it should be appreciated that the hooks 80, 82, as well as the associated hook cylinders 124, 114, may include the same or similar structural and/or operational features. Additionally, a controller 130 (e.g., electronic controller) having a processor 132 and a memory 134 is shown in FIG. 8 to facilitate discussion. It should be appreciated that the controller 130 may provide control signals to the boost actuators 34, the hook cylinders 114, 124, the lock actuators, the one or more hoisting cylinders 26, and/or any of a variety of other components of the boost system 14 and/or the hoisting system 12. The processor 132 may execute instructions stored in the memory 134 to provide the control signals to carry out the techniques disclosed herein. For example, the processor 132 may execute the instructions stored in the memory 134 to provide the control signals to adjust the hooks 80, 82 and the climb units 32, 33 in a coordinated manner to move the boost assemblies 38 vertically upwardly and downwardly relative to the tracks 30.

As noted herein, the boost system 14 may be operated to incrementally raise the upper climb units 32 and the lower climb units 33 upwardly along the vertical axis 40 to provide the supplemental force to the yoke 24, but also to incrementally lower the upper climb units 32 and the lower climb units 33 downwardly along the vertical axis 40 toward the well to thereby reposition the boost assemblies 38 for subsequent boost operations, for example. Additionally or alternatively, the upper climb units 32 may be configured to couple to the yoke 24 (e.g., via locks), and the upper climb units 32 and the lower climb units 33 may be configured to decouple or disconnect from the tracks 30 via adjustment of the hooks 80, 82 to the disengaged configuration (in some embodiments, the upper climb units 32 and/or the lower climb units 33 may remain in contact with the tracks 30, such as via vertical slots that enable movement along the vertical axis 40). In this way, the boost assemblies 38 may be suspended from the yoke 24. In such cases, the boost assemblies 38 may be efficiently lifted or lowered relative to the tracks 30 via movement of the yoke 24 due to the hoisting force provided by the one or more hoisting cylinders 26 (e.g., over larger distances, such as from a top portion of the tracks 30 to a bottom portion of the tracks 30; without a sequence of incremental steps along the track 30).

Figure 9:
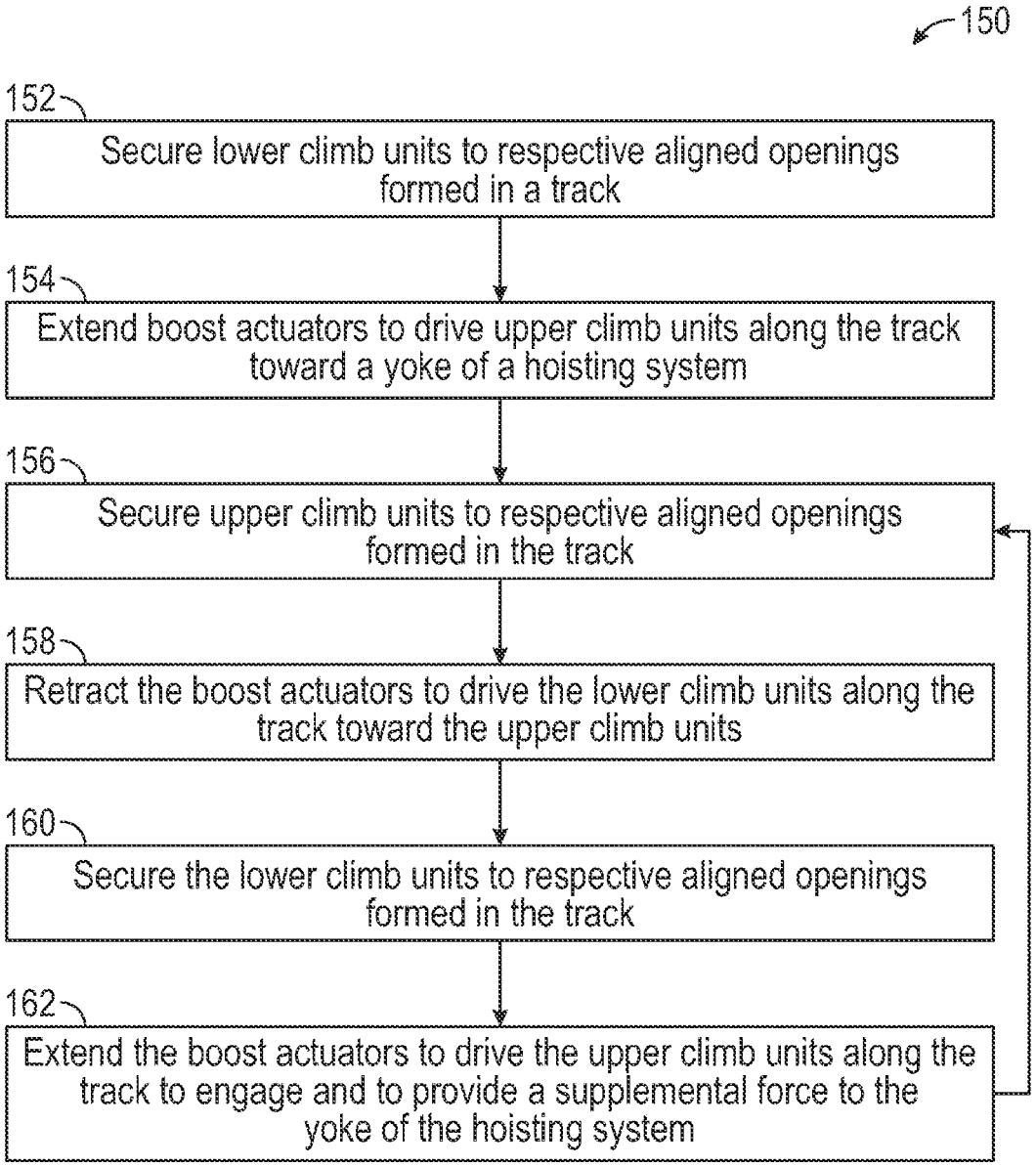
FIG. 9 is flow diagram of a method of operating a boost system for a hoisting system, in accordance with an embodiment of the present disclosure.

FIG. 9 is flow diagram of a method 150 of operating a boost system for a hoisting system, in accordance with an embodiment of the present disclosure. It should be appreciated that steps of the method 150 may be performed by a controller, such as the controller 130 of FIG. 8. It should be appreciated that steps may be omitted, steps may be added, and/or steps may be carried out in any suitable order.

In block 152, the method 150 may begin by securing lower climb units to respective aligned openings formed in a track of a boost system. In block 154, the method 150 may continue by extending boost actuators to drive upper climb units along the track toward a yoke of a hoisting system. In block 156, the method 150 may continue by securing upper climb units to respective aligned openings formed in the track of the boost system. In block 158, the method 150 may continue by retracting the boost actuators to drive the lower climb units along the track toward the upper climb units. In block 160, the method 150 may continue by securing the lower climb units to the respective aligned openings formed in the track. In block 162, the method 150 may continue by extending the boost actuators to drive the upper climb units along the track to engage and to provide a supplemental force to the yoke of the hoisting system. As shown, the method 150 may return to block 156 and may continue to carry out blocks 156-162 to provide increments of supplemental force to the yoke of the hoisting system.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. For example, features described with respect to FIGS. 1-7 may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A boost system for a hoisting system, the boost system comprising:

a track configured to couple to a mast; and a boost assembly comprising:

an upper climb unit with a respective hook configured to selectively engage openings in the track;

a lower climb unit with a respective hook configured to selectively engage the openings in the track; and a boost actuator configured to drive the upper climb unit along the track and relative to the lower climb unit to provide a supplemental force to a yoke of the hoisting system.

2. The boost system of claim 1, wherein the boost actuator is configured to extend while the respective hook of the upper climb unit is disengaged from the openings in the track and while the respective hook of the lower climb unit is engaged with the openings in the track to thereby drive the upper climb unit along the track and relative to the lower climb unit to provide the supplemental force to the yoke of the hoisting system.

3. The boost system of claim 1, wherein the boost actuator is configured to retract while the respective hook of the upper climb unit is engaged with the openings in the track and while the respective hook of the lower climb unit is disengaged with the openings in the track to thereby drive the lower climb unit along the track toward the upper climb unit.

4. The boost system of claim 1, wherein the boost actuator comprises a lock configured to lock the upper climb unit to the yoke.

5. The boost system of claim 1, comprising a controller configured to control the boost actuator to move the boost assembly along the track in a step-wise manner to contact the yoke and to provide the supplemental force to the yoke.

6. A method of operating a boost system, the method comprising:

while a lower climb unit is secured to a track, extending a boost actuator to drive an upper climb unit along a first section of the track to provide a supplemental force to a yoke of a hoisting system.

7. The method of claim 6, comprising:

subsequently securing the upper climb unit to the track;

subsequently, while the upper climb unit is secured to the track, retracting the boost actuator to drive the lower climb unit along a second section of the track;

subsequently securing the lower climb unit to the track; and subsequently, while the lower climb unit is secured to the track, extending the boost actuator to drive the upper climb unit along a third section of the track to provide the supplemental force to the yoke of the hoisting system.

* * * * *